US007422523B2

(12) United States Patent
Wood

(10) Patent No.: US 7,422,523 B2
(45) Date of Patent: Sep. 9, 2008

(54) HANDHELD PINBALL GAME HAVING A CHANGEABLE DISPLAY

(76) Inventor: Ethan Wood, 5960 B Medocino Dr., Apartment 106, Dallas, TX (US) 75248

( * ) Notice: Subject to any disclaimer, the term of this patent is extended or adjusted under 35 U.S.C. 154(b) by 480 days.

(21) Appl. No.: 10/776,759

(22) Filed: Feb. 10, 2004

(65) Prior Publication Data

US 2005/0176501 A1 Aug. 11, 2005

(51) Int. Cl.
*A63F 7/02* (2006.01)

(52) U.S. Cl. ..... 463/31; 463/30; 463/31; 463/33; 463/37; 273/121 B; 273/317.1; 273/461; 455/556.2

(58) Field of Classification Search ..... 463/2, 463/3, 7, 30–34, 37, 35; 273/118 R, 118 A, 273/108.2, 108.21, 108.5, 109, 119, 120 A, 273/129 R, 129 K, 317.2, 461, 119 R, 120 R, 273/121 R, 121 A, 121 B, 121 D, 121 E, 273/122 R, 122 A, 119 A, 119 B, 123 R, 273/124 R, 124 A, 125 R, 125 A, 123 A, 273/118 D, 157 A, 317.1, 329; 434/252, 434/54, 181, 364, 427; 473/131–409, 570, 473/615; 455/556.2

See application file for complete search history.

(56) References Cited

U.S. PATENT DOCUMENTS

| | | | | |
|---|---|---|---|---|
| 4,249,744 | A | 2/1981 | Bromley | |
| 4,253,090 | A | 2/1981 | Storie et al. | |
| D259,266 | S | 5/1981 | Heuel et al. | |
| 4,322,073 | A | 3/1982 | Slavik et al. | |
| 4,324,402 | A | 4/1982 | Klose | |
| D265,102 | S | 6/1982 | Sato | |
| 4,334,679 | A * | 6/1982 | Doyle et al. | 463/3 |
| 4,346,892 | A | 8/1982 | Kitchen et al. | |
| D266,775 | S | 11/1982 | Hanzawa | |
| 4,372,557 | A | 2/1983 | Del Principe et al. | |
| 4,386,776 | A * | 6/1983 | Bromley | 463/4 |
| 4,401,304 | A | 8/1983 | Hamano | |
| 4,415,153 | A | 11/1983 | Yokoi | |
| 4,418,917 | A | 12/1983 | Jalali et al. | |
| 4,448,417 | A * | 5/1984 | Clark et al. | 273/121 A |
| 5,026,058 | A | 6/1991 | Bromley | |

(Continued)

FOREIGN PATENT DOCUMENTS

| | | |
|---|---|---|
| JP | 04114638 | 7/1992 |

OTHER PUBLICATIONS http://web.archive.org/web/20031008184746/http://gamestech.com/Game_boy_AdvanceSP/gbasp.htm (Oct. 8, 2003).*

*Primary Examiner*—Robert E Pezzuto
*Assistant Examiner*—Arthur O. Hall
(74) *Attorney, Agent, or Firm*—Bell, Boyd & Lloyd LLP

(57) ABSTRACT

A hand-held pinball game has a changeable display. The pinball game has a housing having a front face. A display screen is formed in the front face of the housing. A first opening is formed in the housing. A display card is visible through the display screen. The display card is insertable and removable through the first opening. A second opening in the housing receives additional display cards so that the pinball game display may be changed by a player. An impact sensor in the housing allows the player to nudge the housing to change the path of the simulated pinball.

32 Claims, 5 Drawing Sheets

U.S. PATENT DOCUMENTS 5,088,736 A * 2/1992 Chuang ..... 273/121 R
5,095,798 A * 3/1992 Okada et al. ..... 463/35
5,112,049 A * 5/1992 Borg ..... 273/127 D
5,137,277 A 8/1992 Kitaue
5,184,830 A * 2/1993 Okada et al. ..... 463/29
5,215,311 A * 6/1993 Schuller ..... 463/9
5,280,908 A * 1/1994 Lu ..... 273/121 R
5,338,031 A * 8/1994 Patla et al. ..... 273/118 R
5,415,401 A * 5/1995 Nagasaka ..... 273/110
5,508,720 A * 4/1996 DiSanto et al. ..... 345/169
5,700,193 A * 12/1997 d'Achard Van Enschut .... 463/3
5,718,336 A * 2/1998 Haarlander ..... 206/542
5,725,210 A 3/1998 Yamaguchi
6,036,188 A * 3/2000 Gomez et al. ..... 273/118 R
6,120,379 A * 9/2000 Tanaka et al. ..... 463/44
6,129,353 A 10/2000 DeMar et al.
6,241,611 B1 * 6/2001 Takeda et al. ..... 463/38
6,315,669 B1 * 11/2001 Okada et al. ..... 463/44
6,375,572 B1 * 4/2002 Masuyama et al. ..... 463/43
6,390,470 B1 * 5/2002 Huang ..... 273/121 R
6,427,078 B1 * 7/2002 Wilska et al. ..... 455/550.1
6,478,679 B1 * 11/2002 Himoto et al. ..... 463/36
6,612,573 B2 * 9/2003 Klitsner et al. ..... 273/120 A
6,743,104 B1 * 6/2004 Ota et al. ..... 463/44
6,914,594 B2 * 7/2005 Chuang ..... 345/169
2001/0036862 A1 * 11/2001 Kitamori et al. ..... 463/37
2002/0030581 A1 * 3/2002 Janiak et al. ..... 340/5.53
2002/0067408 A1 * 6/2002 Adair et al. ..... 348/76
2002/0074404 A1 * 6/2002 Drumm ..... 235/462.01
2003/0050537 A1 * 3/2003 Wessel ..... 600/300
2003/0218064 A1 * 11/2003 Conner et al. ..... 235/439
2004/0023719 A1 * 2/2004 Hussaini et al. ..... 463/37

* cited by examiner

HANDHELD PINBALL GAME HAVING A CHANGEABLE DISPLAY

FIELD OF THE INVENTION

The present invention relates to a hand-held pinball game. More particularly, the present invention relates to a hand-held pinball game having a changeable display. Still more particularly, the present invention relates to a hand-held pinball game having a changeable display and an impact sensor that changes the path of a simulated pinball during play. The hand-held pinball game has a removable display card that may be replaced with another display card to change the image viewable through a display screen of the game.

BACKGROUND OF THE INVENTION

Hand-held electronic games have been widely popular toys since their introduction. These games provide portable versions of favorite games previously found only in arcades or at home on a personal computer or video game system. The ease of use and the portability of hand-held electronic games provide enjoyment to a wide range of electronic game players.

Hand-held electronic pinball games are one of many popular hand-held electronic games. Advances in electronic technology have allowed these hand-held electronic pinball games to closely simulate the original stand-up pinball games, thereby allowing pinball fans to play whenever and wherever they want.

One problem with existing hand-held electronic pinball games is the inability to change the display image of the game. With stand-up pinball games, when players become tired of playing a particular machine they can simply move to another stand-up pinball game and continue playing on the new machine. However, existing hand-held electronic pinball games are not so versatile as to allow players to change the display of the game to essentially create a brand new game. If a player becomes tired of a certain game, they must either have another hand-held electronic pinball game available or stop playing. A need exists for a hand-held pinball game in which a player may change the display.

Stand-up pinball games allow a player to shake or move the pinball game, within reason, to change the path of the pinball. A "tilt" generally occurs if the stand-up pinball game is either moved too much or too violently. Another problem with existing hand-held electronic pinball games is not being able to change the path of the ball through movement of the hand-held game as can be done with stand-up pinball games. A need exists for a hand-held pinball game in which a player may change the path of the simulated pinball by tapping or nudging the housing of the game, and which includes a tilt feature to prevent over-use of the tapping feature.

Existing handheld pinball games do not have changeable displays. U.S. Pat. No. 4,334,679 to Doyle et al. discloses a hand-held pinball game having LED's that are energized to simulate a pinball and flippers and a speaker to provide pinball sounds. U.S. Pat. No. 4,253,090 to Storie et al. discloses a plunger for a hand-held electronic pinball game. U.S. Pat. No. 6,612,573 to Klitsner et al. discloses an electronic hand-held game having user manipulated controls for controlling the direction and power of a simulated launched object.

A need exists for an improved hand-held pinball game having a changeable display.

SUMMARY OF THE INVENTION

Accordingly, it is a primary object of the present invention to provide an improved hand-held pinball game.

Accordingly, another object of the present invention is to provide a hand-held pinball game having a changeable display.

Accordingly, another object of the present invention is to provide a hand-held pinball game having a tap or nudge feature to allow a player to change the path of the simulated pinball.

The foregoing objects are basically attained by providing a hand-held pinball game having a changeable display. The pinball game has a housing having a front face. A display screen is formed in the front face of the housing. A first opening is formed in the housing. A display card is visible through the display screen. The display card is insertable and removable through the first opening. A second opening in the housing receives additional display cards so that the pinball game display may be changed by the player. An impact sensor in the housing allows the player to nudge the housing to change the path of the simulated pinball.

The foregoing objects are also attained by providing a method of playing a hand-held pinball game. The pinball game is initially played with a first display card viewable through a display screen in the housing of the pinball game. A user may then remove the first display card through a first opening in the housing and insert a second display card through the first opening in the housing. The user may then continue playing the pinball game with the second display card viewable through the display screen in the housing of the pinball game.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
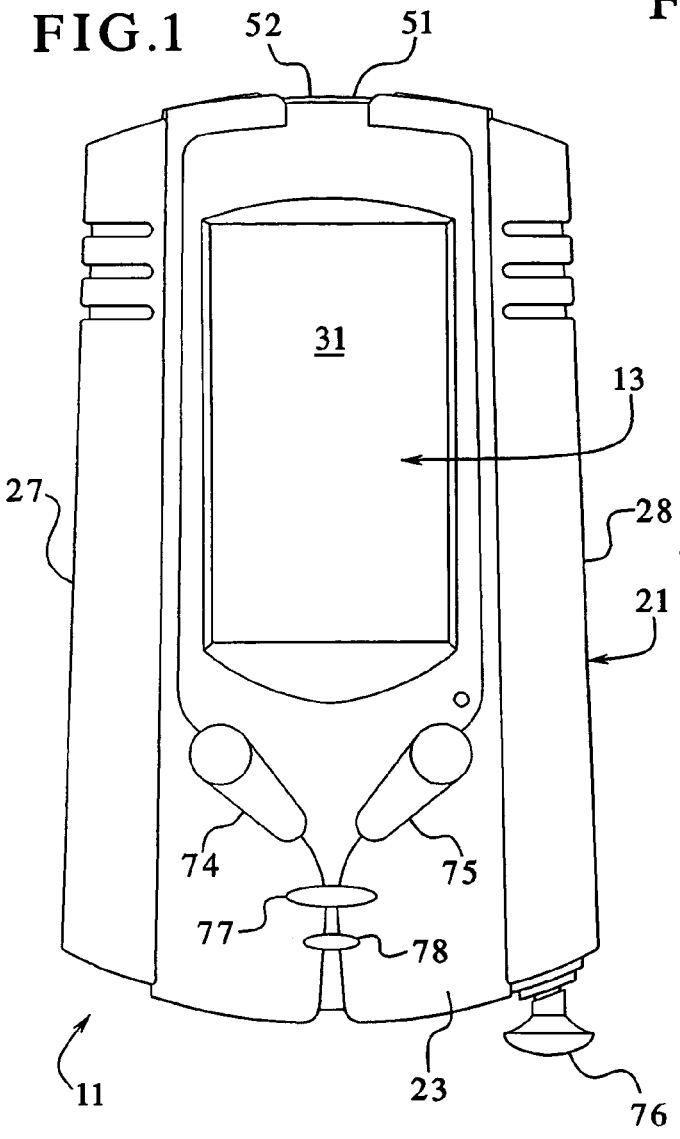
FIG. 1 is a front elevational view of the hand-held pinball game of the present invention.

As shown in FIGS. 1-12, a hand-held pinball game 11 has a changeable display 13. The hand-held pinball game 11 has a housing 21 having a front face 23. A display screen 31 is formed in the front face 23 of the housing 21. A first opening 41 in the housing 21 receives a first display card 51, which is visible through the display screen 31. The first display card 51 is insertable and removable through the first opening 41. A second opening 43 in the housing receives a second display card 53 so that the pinball game display 13 may be changed by a player. An impact sensor 61 in the housing 21 allows the player to nudge or tap the housing 21 to change the path of the simulated pinball 71.

Figure 2:
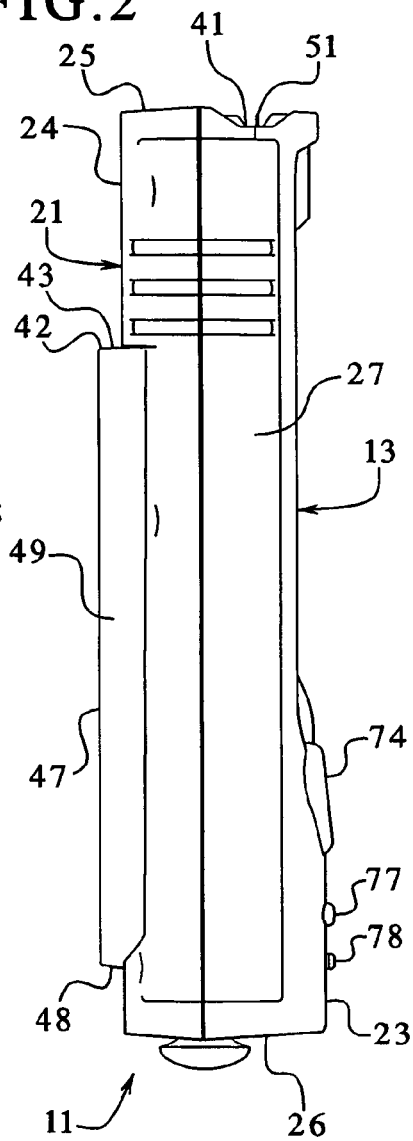
FIG. 2 is a side elevational view of the hand-held pinball game of FIG. 1.
Figure 3:
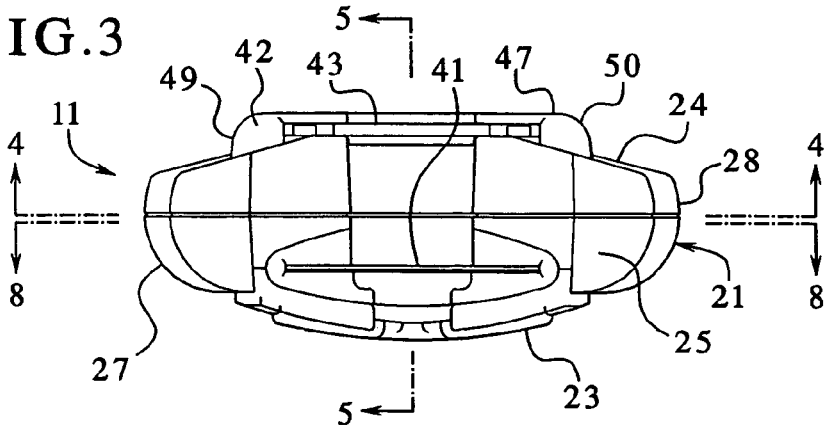
FIG. 3 is a top plan view of the hand-held pinball game of FIG. 1.

The housing 21, as shown in FIGS. 1-3, has a front face 23 and a back face 24. Top face 25 extends between top edges of the front and back faces. Bottom face 26 extends between bottom edges of the front and back faces. Side faces 27 and 28 extend between side edges of the front and back faces. Preferably, the housing 21 is made of plastic.

Figure 11:
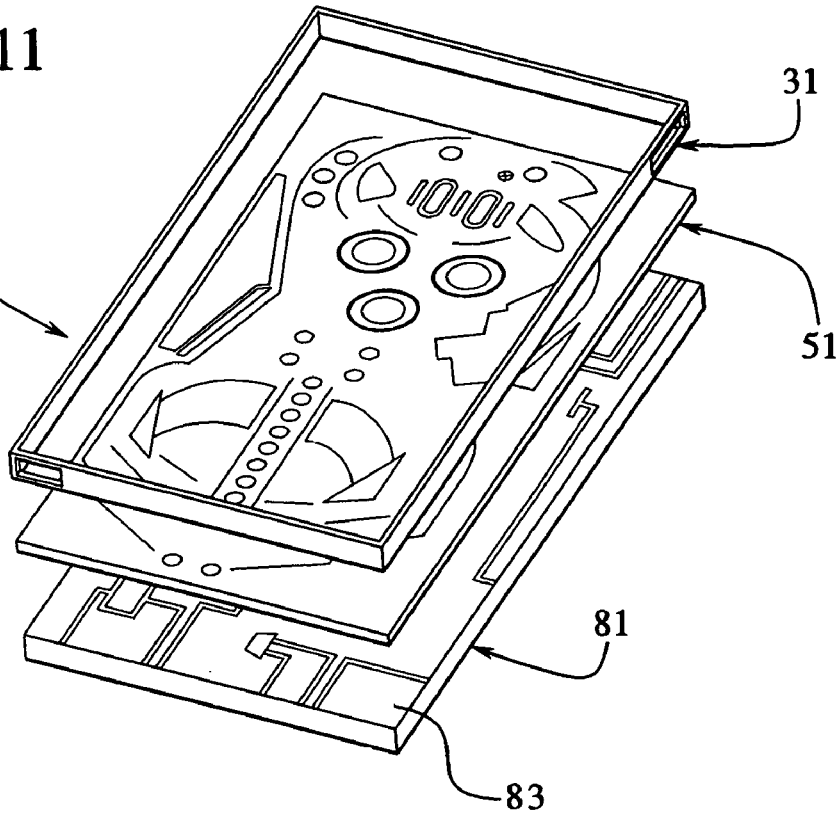
FIG. 11 is a perspective view of a display, including a display screen, a display card and a printed circuit board.
Figure 12:
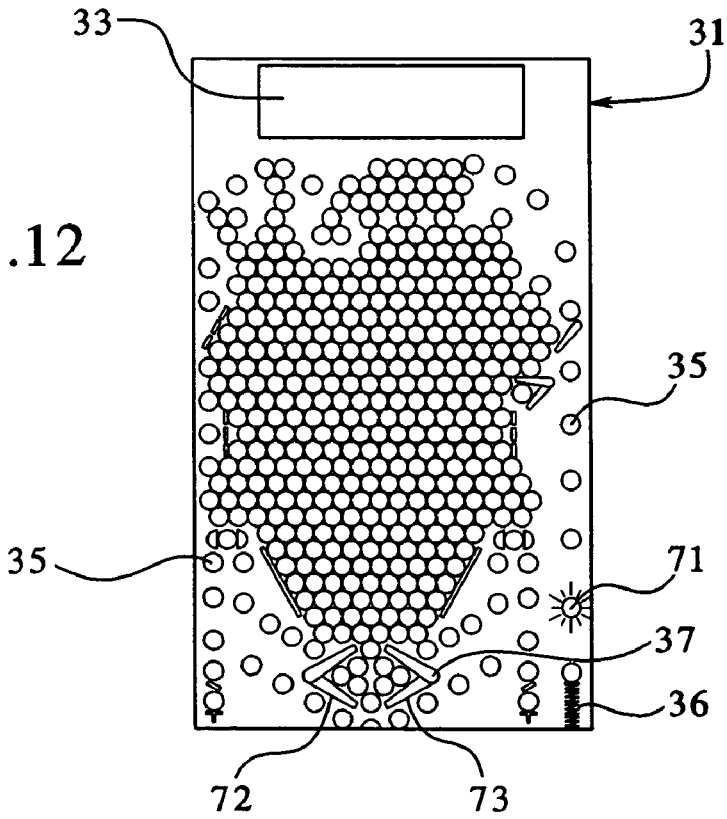
FIG. 12 is a top plan view of a display screen.

A display 13 is formed in the front face 23 of the housing 21, as shown in FIGS. 1 and 11. The display 13 includes a display screen 31, which is preferably an LCD, as shown in FIG. 12. The display screen 31 has a dot-matrix portion 33 for displaying animations and text. The display screen 31 also has a plurality of pinball segments 35 that are energized to correspond to various positions of the simulated pinball 71, as well as a plurality of plunger segments 36 and a plurality of flipper segments 37 corresponding to left and right flippers 72 and 73. The pinball segments 35 are sequentially energized to depict the path of the pinball 71 throughout the display screen 31. The pinball segment 35 corresponding to the precise location of the simulated pinball 71 at that instant is energized to show the location of the pinball, which in FIG. 12 is shown as just having been launched. A plurality of plunger segments 36 are energized depending on the amount of power to be given to the simulated pinball 71 at launch. The more plunger segments 36 that are de-energized at launch, i.e., the fewer plunger segments that are visible, the more power that is to be provided to the simulated pinball 71 at launch. Conversely, the fewer plunger segments 36 that are de-energized, i.e., the more plunger segments that are visible, the less power that is to be supplied to the simulated pinball 71 at launch.

A first display card 51 is disposed behind the display screen 31, and is visible through the display screen, as shown in FIG. 11. The first display card 51 is imprinted with graphics viewable through the display screen 31. Preferably, the first display card 51 is substantially planar. A tab 57 extending from the bottom edge 56 of the first display card has an opening in a position to allow completion of a circuit when a contact is allowed to touch specific locations on the PC board. The processor will activate a specific game depending on the electrical path completed that is exclusive to that card. The tab 57 of the first display card 51 interacts with the printed circuit board 81 to enable features of play exclusive to that display card. A second display card 53 has substantially the same overall shape as the first display card 51 to facilitate their interchangeability. The second display card 53 has different graphics to provide a different game to the player, as well as the tab opening being located in a different position on the tab to allow a different electrical path to be completed, thereby creating a different game exclusive to the second card. Each display card has a tab opening or tab openings in different positions or of different sizes to create a variety of different electrical paths. Each different electrical path corresponds to a different game that is unique to that particular display card.

A printed circuit board 81 is disposed behind the display card 51. Preferably, the printed circuit board 81 has a plurality of LED's 83 mounted thereon to simulate lights of a stand-up pinball game. Preferably, the LED's 83 are various colors to provide a multi-color display.

A first opening 41 in the housing 21 allows the first display card 51 to be inserted and removed from the housing, as shown in FIGS. 5-10. Preferably, the first opening 41 is in the top face 25 of the housing, as shown in FIGS. 2 and 3. The first opening 41 receives a display card and allows it to be positioned behind the display screen 31 and in front of the printed circuit board 81, as shown in FIG. 11.

Figure 6:
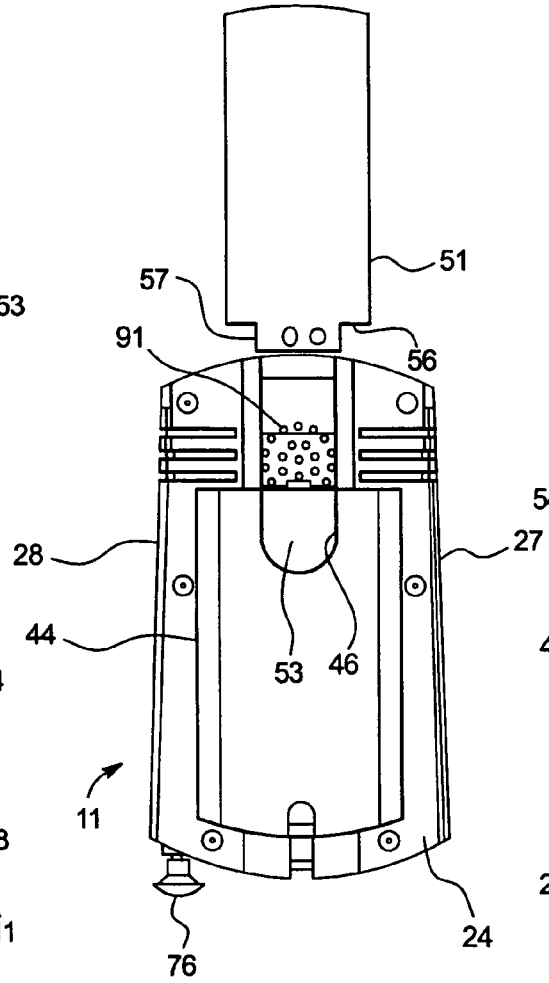
FIG. 6 is a rear elevational view of the hand-held pinball game of FIG. 1 with a display card above a first opening.
Figure 7:
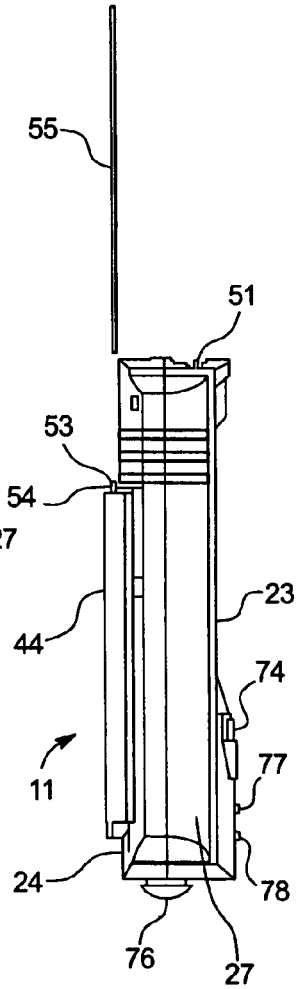
FIG. 7 is a side elevational view of the hand-held pinball game and display card of FIG. 5.
Figure 8:
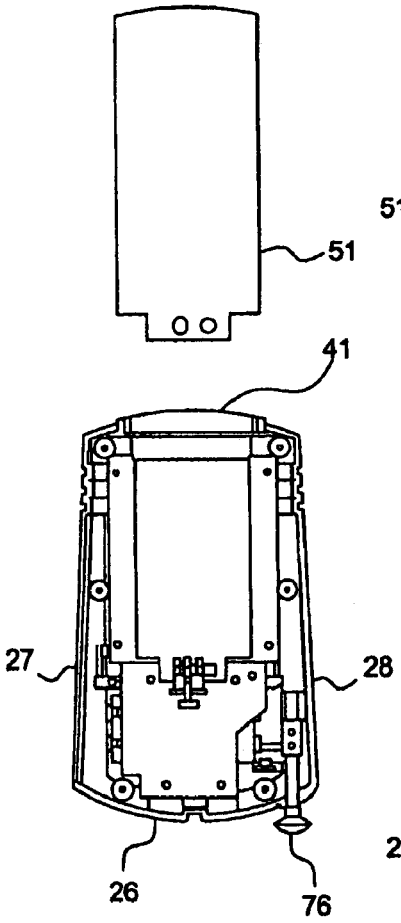
FIG. 8 is a front elevational view in partial cross section of the hand-held pinball game along line 8-8 of FIG. 3 with a display card above a first opening.
Figure 9:
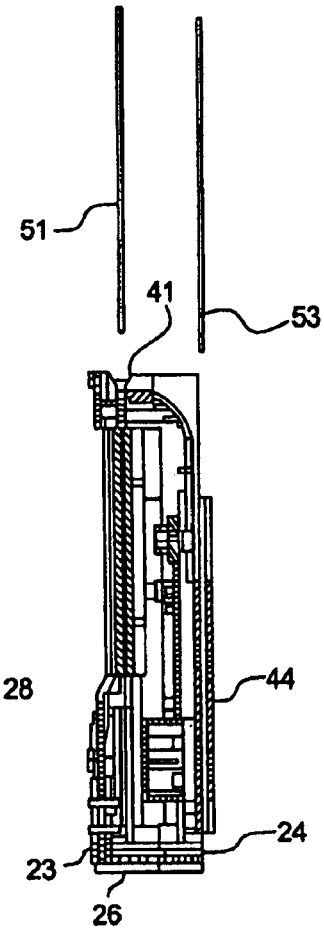
FIG. 9 is a side elevational view in partial cross section of the hand-held pinball game of FIG. 5 showing a first display card above a first opening and a second display card above a second opening.
Figure 10:
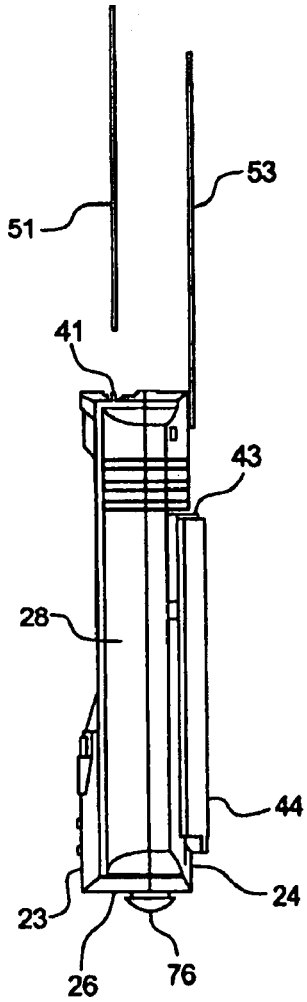
FIG. 10 is a side elevational view of the hand-held pinball game of FIG. 9 showing first and second display cards above first and second openings.

A second opening 43 in the housing 21 receives a second display card 53, as shown in FIGS. 8-10. Preferably, the second opening 43 is in a top wall 42 of a pocket 44, as shown in FIG. 6, attached to the back side 24 of the housing 21. The pocket 44 is attached to the housing 21 by a fastener received in the fastener hole 45 in the housing, shown in FIG. 4. The pocket 44 has a back wall 47, bottom wall 48 and side walls 49 and 50 to hold display cards within the pocket. The pocket 44 may store a plurality of display cards 55 to be interchanged with the display card currently received in the first opening 41. A recess 46 in the pocket 44 allows a player to slide out a stored display card with a finger. The fastener hole is positioned within the recess 46.

Figure 4:
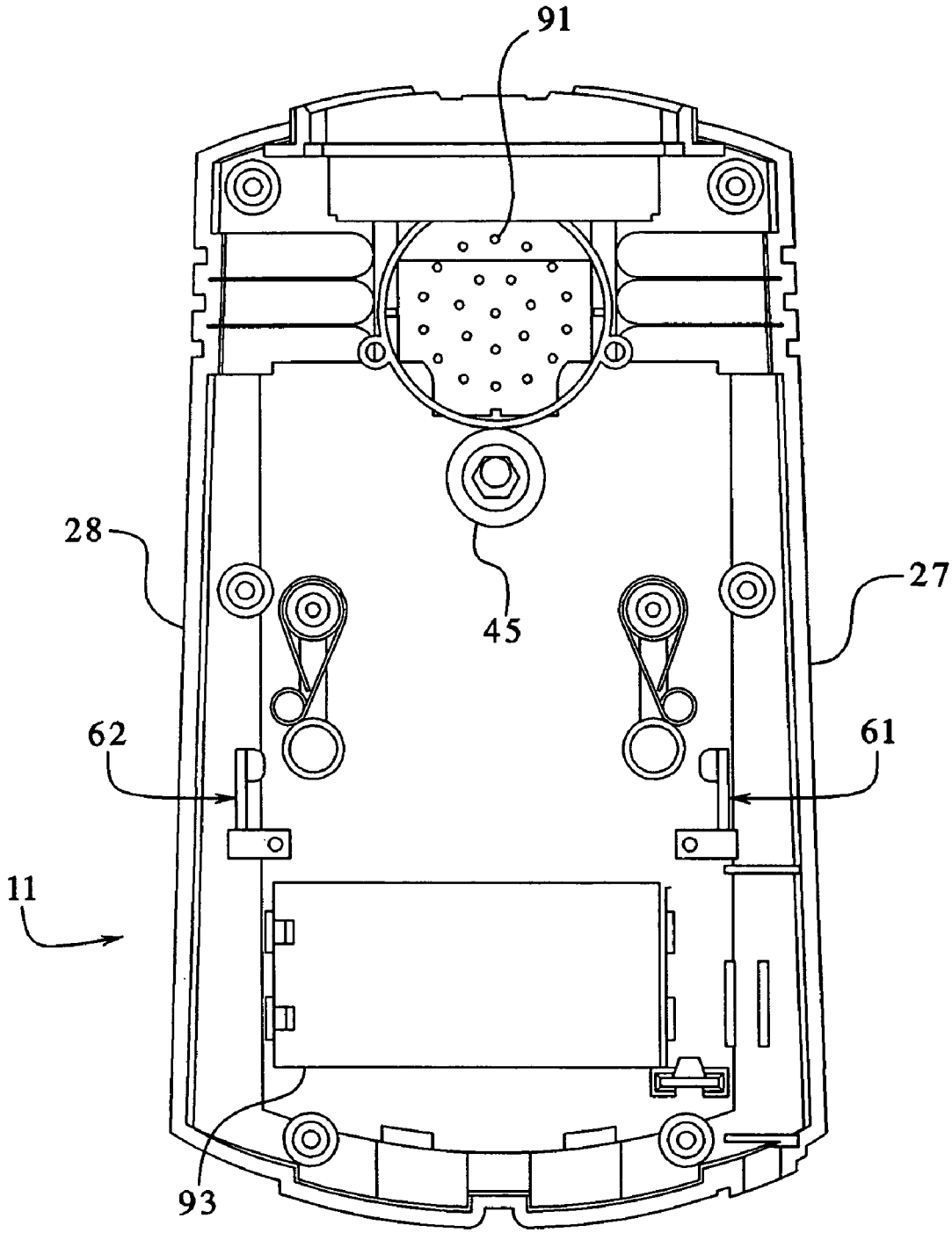
FIG. 4 is a front elevational view of the hand-held pinball game in cross section along line 4-4 of FIG. 3.

An impact sensor 61 includes a spring weighted actuator 63 that is attached on one end to the housing 21 and a switch 65 is disposed within the housing 21 of the game 11. The impact sensor switch 65 is activated by movement of the housing 21 when a player nudges or taps the housing. The weighted actuator 63 is attached to the housing 21 at one end 64 and contains a weight 67 on the other end that swings in a pendulum motion when the game is tapped or nudged by the player. The weighted actuator 63 is damped by a torsion spring 69 that maintains a neutral position when the game is at rest. The switch 65 is activated when the weighted actuator 63 moves laterally and contacts the switch when the game is tapped or nudged by the player. Preferably, there are first and second impact sensors 61 and 62. Preferably, the second impact sensor is a mirror image of the first impact sensor, as shown in FIG. 4. A first impact sensor 61 is positioned proximal the left face 27 of the housing 21, and a second impact sensor 62 is positioned proximal the right face 28 of the housing. Movement of the left and right faces of the housing is detected by the corresponding impact sensors 61 and 62, which transmits a signal to the printed circuit board 81, thereby shifting the simulated pinball 71. Preferably, the impact sensor is a conventional reed switch. The program allows a limited number of impacts to change the ball path within a given time frame. If the number of impacts during an established time frame is exceeded, the game will "tilt" and terminate.

Figure 5:
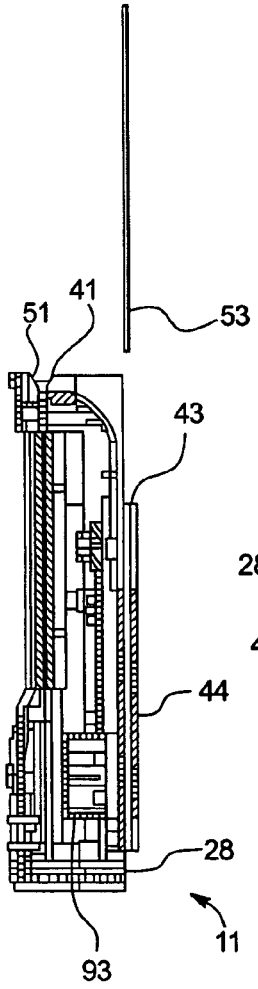
FIG. 5 is a side elevational view in partial cross section of the hand-held pinball game along line 5-5 of FIG. 3 and a display card above a second opening.

A battery compartment 93 receives batteries to supply power for the game 11, as shown in FIG. 4. Any suitable manner of supplying power may be used in lieu of batteries. The battery compartment is preferably accessible from the back face 24 of the housing 21. The pocket 44 is positioned on top of the battery compartment, as shown in FIGS. 5 and 6. The fastener opening in the pocket 44 is positioned within the recess 46. Display cards stored in the pocket 44 cover the fastener in the fastener opening, thereby preventing it from being visible to the player.

Assembly and Disassembly

As shown in FIGS. 1-3, 6 and 10, the hand-held pinball game 11 is shown fully assembled. The hand-held pinball game 11 has first and second openings 41 and 43 for interchangeably receiving first and second display cards 51 and 53 to provide a versatile hand-held electronic pinball game.

The first opening 41 in the top face 25 of the housing receives a first display card 51, as shown in FIG. 1. A second opening 43 in the pocket 44 secured to the back face 24 of the housing receives a second display card 53. Additional display cards 55 may also be housed in the pocket 44. When a player inserts the first display card 51 in the first opening, the first display card is positioned between the display screen 31 and printed circuit board 81, as shown in FIG. 11. Batteries inserted in the battery compartment 93 provide power. Once batteries are inserted in the battery compartment, a fastener is inserted through the fastener holes in the pocket and the back face 24 of the housing 21 to secure the pocket 44 to the housing 21. Display cards received in the pocket 44 cover the fastener to prevent it from being visible to the player.

Pressing the power button 77 causes the batteries to supply power to the printed circuit board 81, display screen 31 and speaker 91. Text messages allowing the player to select various features of the game are displayed in the dot-matrix portion 33 of the display screen. LED's 83 mounted on the printed circuit board are lit to simulate the lights of a stand-up pinball game. Speaker 91 emits sounds in response to play of the hand-held pinball game 11 to simulate the sounds of a stand-up pinball game. Pressing sound button 78 alternately turns the speaker 91 on and off, thereby allowing the player to mute the sounds if desired.

Once the desired features of the game have been selected, a simulated pinball 71 is launched into play by pulling back on the plunger 76. Initially, all the plunger segments 36 are energized. As the plunger 76 is pulled further back, more plunger segments 36 become de-energized and disappear. The fewer plunger segments 36 that are visible, i.e., the more plunger segments that are de-energized, the more power that is to be supplied to the launched simulated pinball 71. If a weaker launch is desired, a minimal amount of plunger segments 36 should be de-energized. The player releases the plunger 76 when a desired amount of plunger segments 36 have been de-energized corresponding to the amount of power to be supplied to the simulated pinball 71.

When the simulated pinball 71 is launched, as shown in FIG. 12, sequential pinball segments 35 are energized, thereby displaying motion of the simulated pinball 71. Flipper buttons 74 and 75 (FIG. 1) are pressed to activate simulated flippers 72 and 73 (FIG. 12) to keep simulated pinball 71 in play. Impact sensors 61 and 62 (FIG. 4) allow the player to alter the path of the simulated pinball 71, as players can do in stand-up pinball games. Impact sensors 61 and 62 sense motion of the left and right faces 27 and 28 of the housing 21 and transmit a signal to the printed circuit board, thereby shifting the path of the simulated pinball. The circuit board may be configured to alter the path of the simulated pinball in any manner desired. Preferably, the path of the simulated pinball 71 is shifted one pinball segment to the left or right according to the face of the housing that is nudged or tapped by the player. The pinball game 11 may also be configured with a counter so that overuse of the nudging or tapping feature results in a tilt and loss of the ball in play, as in a stand-up pinball game. Preferably, the counter is configured to cause a tilt to occur when the nudge feature is used a predetermined amount of times in a predetermined amount of time, such as nudging three times in 90 seconds results in a tilt. The counter resets whenever the predetermined amount of time has lapsed without a tilt occurring.

Whenever the player wants to change the display 13 of the game 11, the first display card 51 is removed through the first opening 41 by gripping the tip 52 of the first display card, as shown in FIG. 6. The first display card 51 may then be inserted in the second opening 43 of the housing to store the first display card for future use. The second display card 53 is slid out of the second opening 43 by pressing a finger in the recess 46 in the pocket 44, as shown in FIG. 6. The second display card 53 may then be inserted in the first opening 41 between the display screen 31 and the printed circuit board 81 to create a new display image in the display 13, thereby creating a new pinball game to be played by the player.

Although described with regard to a hand-held electronic pinball game, the present invention may be used with any suitable hand-held game.

While advantageous embodiments have been chosen to illustrate the invention, it will be understood by those skilled in the art that various changes and modifications may be made therein without departing from the scope of the invention as defined in the appended claims.

What is claimed is:

1. A hand-held game, comprising:

a housing having a front face;

electrical circuitry within said housing;

a display screen formed in said front face;

a first opening in said housing;

a display card visible through said display screen, said display card having a portion that allows completion of said electrical circuitry and being insertable and removable through said first opening;

a printed circuit board mounted in said housing behind said display card and said display screen; and a plurality of LED's mounted on said printed circuit board and visible through said display screen and said display card.

2. A hand-held game according to claim 1, wherein said first opening is in a top face of said housing.

3. A hand-held game according to claim 1, further comprising a second opening in said housing adapted to receive another display card not received in said first opening for use during play.

4. A hand-held game according to claim 3, wherein said second opening is a pocket secured to a back face of said housing.

5. A hand-held game according to claim 1, wherein said hand-held game is a pinball game.

6. A hand-held game according to claim 5, further comprising an impact sensor in said housing adapted to sense movement of said housing and alters a path of a simulated pinball in said display screen in response thereto.

7. A hand-held game according to claim 5, further comprising a spring-loaded plunger connected to said housing to launch a simulated pinball into play.

8. A hand-held game according to claim 1, further comprising a battery contained in said housing which powers said hand-held game.

9. A hand-held game according to claim 1, wherein said housing is made of plastic.

10. A hand-held game according to claim 1, wherein said housing has at least one speaker to provide sound.

11. A hand-held game according to claim 1, wherein said display screen is an LCD.

12. A hand-held game according to claim 11, wherein said LCD has a dot matrix portion to display text on said dot matrix portion.

13. A hand-held game according to claim 5, further comprising first and second buttons on said front face of said housing which control simulated flippers of said display screen.

14. A hand-held pinball game, comprising:

a housing having a front face and a back face;

a display screen formed in said front face;

an electrical circuit within said housing;

a first opening in said housing;

a first display card visible through said display screen and having an opening of the first display card in a first position and configured to complete said circuit in a first manner;

said first display card being insertable and removable through said first opening;

a second opening in said housing for receiving a second display card, said second display card being interchangeable with said first display card and having an opening of the second display card in a second position and configured to complete said circuit in a second manner; and an impact sensor mounted in said housing to sense movement of said housing, wherein a path of a simulated pinball in said display screen is changed when movement of said housing is sensed by said impact sensor.

15. A hand-held pinball game according to claim 14, wherein said first opening is in a top face of said housing.

16. A hand-held pinball game according to claim 14, further comprising a spring-loaded plunger connected to said housing to launch said simulated pinball.

17. A hand-held pinball game according to claim 14, further comprising a battery contained in said housing which powers said hand-held pinball game.

18. A hand-held pinball game according to claim 14, wherein said housing is made of plastic.

19. A hand-held pinball game according to claim 14, wherein said housing has at least one speaker to provide sound.

20. A hand-held pinball game according to claim 14, wherein said display screen is an LCD.

21. A hand-held pinball game according to claim 20, wherein said LCD has a dot matrix portion to display text on said dot matrix portion.

22. A hand-held pinball game according to claim 14, further comprising a printed circuit board mounted in said housing behind said display card in said first opening and said display screen.

23. A hand-held pinball game according to claim 22, further comprising a plurality of LED's visible through said display screen mounted on said printed circuit board;

wherein a first portion of said LEDs is visible through said first display card when the first display card is inserted through said first opening and a second portion of said LEDs is visible through said second display card when said second display card is inserted through said first opening.

24. A hand-held pinball game according to claim 14, wherein said second opening is a pocket attached to a back face of said housing.

25. A hand-held pinball game according to claim 14, further comprising first and second buttons on said front face of said housing which control simulated flippers of said display screen.

26. A method of playing a hand-held pinball game; comprising the steps of playing the hand-held pinball game in a first manner with a first display card viewable through a display screen in the housing of the hand-held pinball game, the first display card having an opening of the first display card in a first position, which allows completion of an electrical circuit in a first mode;

removing the first display card through a first opening in the housing;

inserting a second display card through the first opening in the housing the second display card having an opening of the second display card in a second position, said opening of the second display card allowing completion of the electrical circuit in a second mode; and playing the hand-held pinball game in a second manner with the second display card viewable through the display screen in the housing of the pinball game.

27. A method of playing a hand-held pinball game according to claim 26, further comprising removing the second display card from a second opening in the housing before inserting the second display card through the first opening; and inserting the first display card in the second opening after removing the first display card from the first opening.

28. A method of playing a hand-held pinball game according to claim 26, further comprising tapping the housing during play to alter a path of a simulated pinball in said display screen.

29. A method of playing a hand-held pinball game according to claim 28, further comprising counting the tapping of the housing during play; and stopping play when a predetermined number of taps has occurred within a predetermined amount of time.

30. A method of playing a hand-held pinball game according to claim 26, further comprising pushing first and second buttons on said housing to move simulated first and second flippers of said display screen.

31. A method of playing a hand-held pinball game according to claim 26, further comprising pulling and releasing a spring-loaded plunger to launch a simulated pinball into play.

32. A method of playing a hand-held pinball game according to claim 26, wherein the step of inserting a second display card through the first opening in the housing includes allowing at least one LED that is mounted on a circuit board in the housing behind the display screen to be visible through the second card when the second card is inserted into the first opening, which is not visible through the first card when the first card is inserted into the first opening.

* * * * *